US007234924B2

(12) United States Patent
Baier et al.

(10) Patent No.: US 7,234,924 B2
(45) Date of Patent: Jun. 26, 2007

(54) ROTARY COMBUSTION ENGINE WITH DEVICE FOR CONVEYING LUBRICATING OIL

(75) Inventors: Wolfgang Baier, Obbach (DE); Manfred Mäthner, Leingarten (DE); Dankwart Eiermann, Weissenberg (DE); Rudolf Klotz, Cottbus (DE); Michael Schirmer, Zermsdorf (DE)

(73) Assignee: Wankel Super Tec GmbH, Cottbus (DE)

( * ) Notice: Subject to any disclaimer, the term of this patent is extended or adjusted under 35 U.S.C. 154(b) by 153 days.

(21) Appl. No.: 11/062,263

(22) Filed: Feb. 18, 2005

(65) Prior Publication Data

US 2005/0186103 A1 Aug. 25, 2005

(30) Foreign Application Priority Data

Feb. 20, 2004 (DE) ..... 10 2004 008 309

(51) Int. Cl.

| | |
|---|---|
| ***F01C 1/02*** | (2006.01) |
| ***F01C 1/063*** | (2006.01) |
| ***F01C 21/04*** | (2006.01) |
| ***F01C 19/00*** | (2006.01) |
| ***F02B 53/00*** | (2006.01) |

(52) U.S. Cl. ..... 418/61.2; 418/91; 418/94; 418/104; 418/142; 123/204

(58) Field of Classification Search ..... 123/204; 418/91, 94, 61.2, 104, 142

See application file for complete search history.

(56) References Cited

U.S. PATENT DOCUMENTS 3,249,094 A * 5/1966 Hoppner et al. ..... 418/61.2
3,260,247 A * 7/1966 Gassmann et al. ..... 418/94
3,333,763 A * 8/1967 Jungbluth et al. ..... 418/91
3,716,312 A * 2/1973 Panhard ..... 418/94
3,743,449 A * 7/1973 Steinwart ..... 418/94
3,876,345 A * 4/1975 Froede et al. ..... 418/84
3,877,852 A * 4/1975 Louzecky ..... 418/94
3,891,357 A * 6/1975 Davis et al. ..... 418/83
3,912,428 A * 10/1975 Chiba et al. ..... 277/357
3,915,599 A * 10/1975 Kawamura ..... 418/91
4,028,022 A * 6/1977 Takeuchi et al. ..... 418/104
4,061,447 A * 12/1977 Kato ..... 418/142
4,116,593 A * 9/1978 Jones ..... 418/94
4,218,200 A * 8/1980 Morita et al. ..... 418/94
4,830,591 A * 5/1989 Eiermann et al. ..... 418/94
4,940,400 A * 7/1990 Speiser et al. ..... 418/94

* cited by examiner

*Primary Examiner*—Thai-Ba Trieu
(74) *Attorney, Agent, or Firm*—Cohen Pontani Lieberman & Pavane LLP

(57) ABSTRACT

A rotary combustion engine with one or more working units, which include a peripheral housing, a front housing plate, a rear housing plate on the output side, an eccentric shaft, and a piston, where the eccentric shaft includes an eccentric, and front and rear sealing parts. Lubricating oil is conveyed by an oil pump from an oil tank through the eccentric shaft to first and second main bearings, and to an eccentric bearing, from which a bevel on the front sealing part conveys it to a piston space, from which it is conveyed by way of a bevel on the piston and a rear bevel back to the oil tank to close the oil circuit. The bevels direct the oil circulation from the front of the working unit to the rear, reduce splash losses, and increase the cooling action on the internal surfaces of the piston.

15 Claims, 2 Drawing Sheets

ROTARY COMBUSTION ENGINE WITH DEVICE FOR CONVEYING LUBRICATING OIL

BACKGROUND OF THE INVENTION

1. Field of the Invention

The invention pertains to a rotary combustion engine with one or more working units, which consist essentially of a peripheral housing, a front plate and a rear or central plate on the output side, an eccentric shaft, and a piston, where the eccentric shaft consists of an eccentric unit comprising an eccentric, a front sealing part, and a rear part. The triangular piston, mounted on the eccentric, rotates between the front plate and the rear or central plate in the peripheral housing to form three working spaces separated from each other by the tips of the piston, which spaces pass through, in succession, a four-phase work cycle. Lubricating oil is conveyed by an oil pump from an oil tank through the eccentric shaft to a first main bearing, to a second main bearing, and to an eccentric bearing.

2. Description of the Related Art

Rotary combustion engines with internal oil lubrication and oil cooling are equipped with an oil tank, from which an oil pump conveys the lubricating oil into an oil circuit. The circuit passes through the interior of the rotary combustion engine and is preferably guided through a central bore in the eccentric shaft to the first main bearing, to the second main bearing, and to the eccentric bearing. The oil leaking from the bearings continues on its way into a first and a second conveying space next to the eccentric, from which it then flows radially outward into a piston space, where the cooling action of the lubricating oil exerts its fullest effect. The return to the oil tank proceeds via oil spaces preferably in the front plate, these spaces being connected to the oil tank.

SUMMARY OF THE INVENTION

Upon consideration of a working unit of a rotary combustion engine with two working units, it is proposed in elaboration of the previously described state of the art that lubricating oil be conducted by an oil pump from an oil tank into an interior space in the eccentric shaft, where the interior space is to be understood as an annular space inside the eccentric shaft, which is assembled from several parts. The annular space surrounds a tie rod. The parts of the shaft are tubular in design, as a result of which a relatively large surface area is obtained for the cooling of the eccentric shaft. The lubricating oil is conveyed from the annular space via oil bores to a first main bearing, to a second main bearing, and to an eccentric bearing; it then flows as leakage oil—as previously described—to the first and second conveying spaces and finally to the piston space. To drain the lubricating oil away, a device for assisting the transport of the lubricating oil is proposed, which takes advantage of the rotational movement of the piston and of the eccentric unit to assist the axial passage of the lubricating oil through the working unit. It has been found advantageous for the lubricating oil to be conducted from the front end through the piston space of the piston and to some extent through openings in the eccentric toward the rear or output side. It is advantageous here for these openings to be provided also in the front sealing part and in the rear sealing part, coinciding with the openings in the eccentric, to ensure that the oil can flow without hindrance.

The eccentric, the front sealing part, and the rear sealing part form an eccentric unit, the shape of which, in conjunction with a hub ring in the piston, serves as a device for conveying the lubricating oil. That is, formations are provided on this unit which help to conduct the lubricating oil, which is therefore accelerated continuously in the intended direction during operation of the rotary combustion engine. After leaving the first main bearing and the eccentric bearing, the lubricating oil arrives in the first conveying space, where it is subjected to centrifugal force by the rotating eccentric shaft and is flung radially outward in the area of the eccentric unit. It then arrives at a ring with a conical inside surface formed on the front sealing part. The oil flows down the beveled surface of this ring toward the eccentric. The ring is fully formed only in the area of the elevation of the eccentric; the opposite side of the ring is only half as wide because of the internal gear wheel mounted on the piston. As a result, a passage is left open, which leads toward the piston space. The lubricating oil arrives in the piston space chiefly via a radially outward-directed channel in the front sealing part facing the eccentric elevation. The leakage oil from the eccentric bearing also arrives at the same space.

The lubricating oil now present in the piston space is conveyed by the kinematics of the piston (for reasons not explained in detail here) from the piston space back in the radially inward direction, where it meets the outer conical shape of the hub ring with the bevel tapering down toward the rear, and is forced toward the output side. In contrast to the front sealing part, the rear sealing part does not have a channel in the area of the eccentric elevation, for which reason centrifugal force has no transporting effect on the lubricating oil. Instead, the lubricating oil is forced on the side opposite the eccentric elevation into the second conveying space in the area of a guide ring, which is only half as wide here. After arriving in this second space, the oil meets the inner conical surface of the rear sealing part. Centrifugal force then urges it toward the oil space in the central plate or, in the case of a rotary combustion engine with one working unit, in the rear plate, from which it drains away.

The front sealing part and the rear sealing part each have a first sealing cylinder to guide the sealing lip of an eccentric shaft seal and a second sealing cylinder to guide the sealing lip of a piston seal to prevent the lubricating oil from passing around the side plates into the working space.

It is therefore the task of the invention to improve the supply of lubricating and cooling oil to a working unit of a rotary combustion engine by optimizing the oil circuit by special design measures for enhancing the cooling of the piston and for avoiding losses.

Other objects and features of the present invention will become apparent from the following detailed description considered in conjunction with the accompanying drawings. It is to be understood: however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

FIG. 2A is a partial plan view of the front sealing part.

DETAILED DESCRIPTION OF THE PRESENTLY PREFERRED EMBODIMENTS

Figure 1:
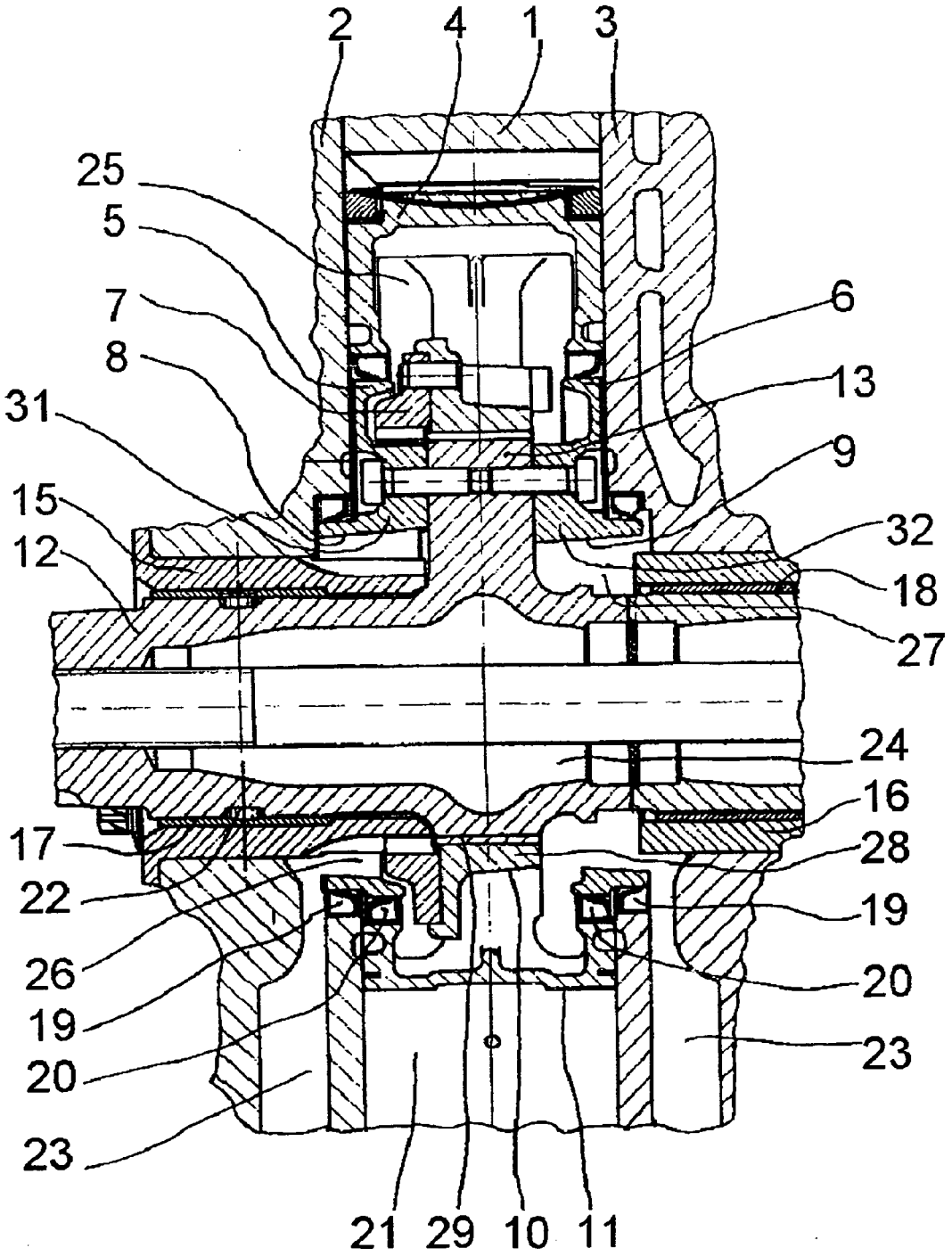
FIG. 1 shows a partial cross section through a rotary combustion engine with two working units with a peripheral housing, a front plate, a central plate, a piston, and an eccentric shaft with an eccentric, on which a front sealing part and a rear sealing part are mounted.

Under the assumption that the rotary combustion engine has two working units, FIG. 1 shows a working unit of a rotary combustion engine consisting of a peripheral housing 1; a front housing plate 2; a piston 4 with a piston face 11, which forms a working space 21; and a rear housing plate 3 which serves as a central housing plate between the two working units. An eccentric shaft 12 with an eccentric 13 is supported in a first main bearing 17 in a first sun wheel 15 in the front plate 2 and in a second main bearing 18 in a second sun wheel 16 in the rear housing plate 3. The eccentric 13 has an eccentric bearing 29, a front sealing part 5, and a rear sealing part 6, where the sealing parts 5 and 6 are permanently connected to the eccentric 13 to form an eccentric unit. Each sealing part 5, 6 has a first sealing cylinder 34 for an eccentric shaft seal 19, one of which is in the front plate 2, the other in the rear housing plate 3. Each sealing part also has a second sealing cylinder 35 for the piston seal 20 in the piston 4. An internal gear wheel 7, which meshes with the first sun wheel 15 and defines its position relative to the eccentric 13, is mounted on the front of the piston 4. The piston 4 has a piston space 25 and a hub ring 28 with an eccentric bearing 29, by means of which the piston 4 is rotatably supported on the eccentric 13.

Figure 2:
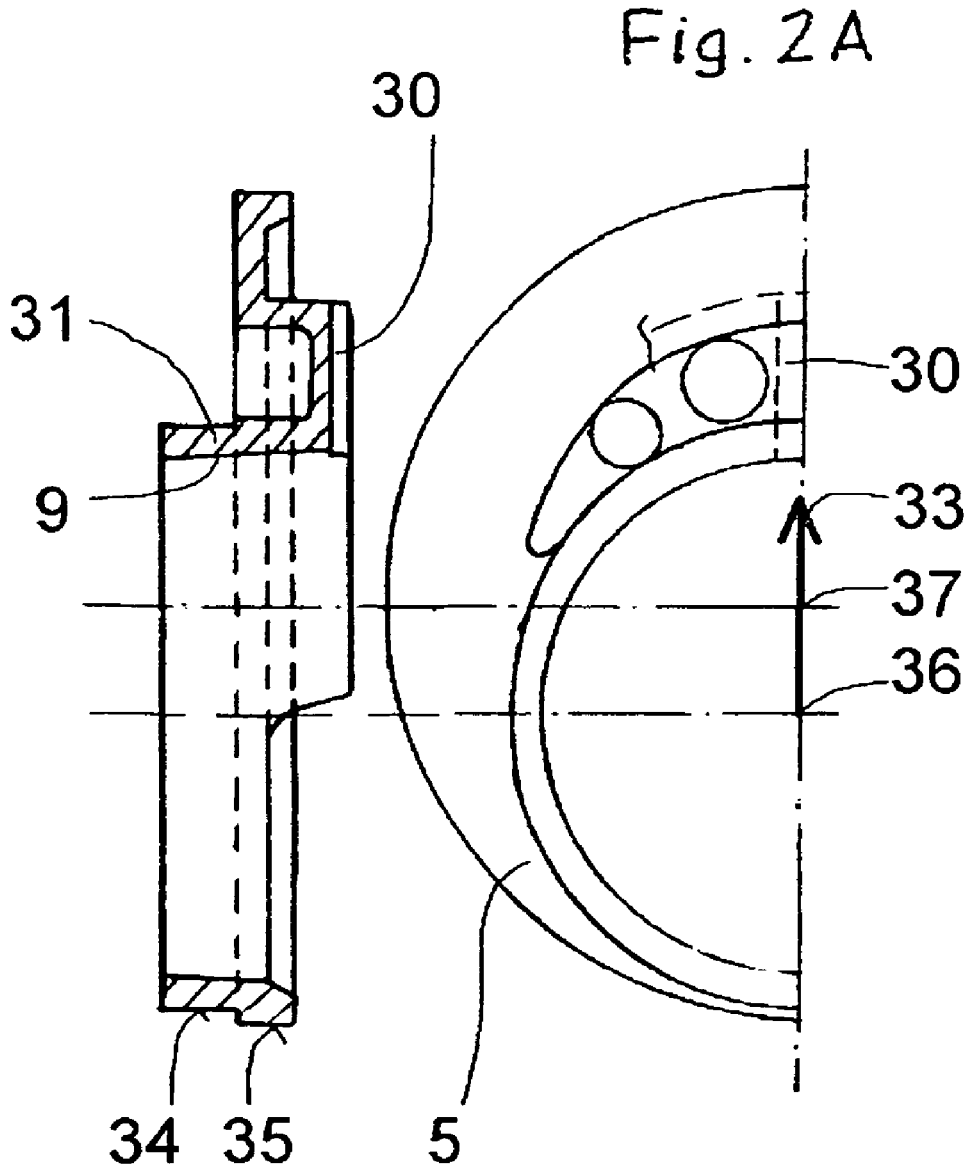
FIG. 2 shows a cross section of the front sealing part.

An oil circuit for the rotary combustion engine is proposed, which is fed from an oil tank by an oil pump, which pumps the lubricating oil first via an interior space 24 of the eccentric shaft 12 into an annular channel 22, from which it arrives as leakage oil via the first main bearing 17 into a first conveying space 26, via the second main bearing 18 into a second conveying space 27, and via the eccentric bearing 29 into the piston space 25. As can be seen in FIG. 2, the front sealing part 5 has a channel 30 in the form of a recess extending in the radial direction 33; the channel faces the eccentric elevation and proceeds in the direction of the arrow 33, which starts from the center 36 of the eccentric shaft as the center of rotation and passes through the center 37 of the eccentric. The channel 30 is located in the area of strongest centrifugal force and transports the lubricating oil directly onto the teeth of the internal gear wheel 7 and then into the piston space 25. To assist the transport of the lubricating oil, a ring 31 is formed on the front sealing part 5. This ring is coaxial to the eccentric shaft, and in the direction 33 it proceeds over the entire width of the front sealing part 5. It is not as wide in the opposite direction, however, in order to leave space for the internal gear wheel 7 and also to establish the connection between the first conveying space 26 and the piston space 25. According to the invention, the ring 31 has on its inside diameter a conical form with a bevel 8 to promote the flow of lubricating oil to the channel 30 in the area of the full width of the ring 31. As a result of the kinematics of the piston, the lubricating oil arriving in the piston space 25 is subjected both to the centrifugal force of the piston rpm's and to the three-times-faster rpm's of the eccentric 13, where the centrifugal force acting as a result of the latter reverses the oil flow at the flank of the piston, so that the oil passes through the area of the eccentric 13 in the direction opposite to direction 33, and continues in the inward direction. This action is what conducts the lubricating oil against a conical shape with a bevel 10 on the hub ring 28, from which the lubricating oil is carried into the second conveying space 27. In analogy to the ring 31 on the front sealing part 5, there is also a guide ring 32 with an internal conical shape on the rear sealing part 6, providing a rear bevel 9. The diameter of the guide ring 32 widens toward the output side and thus conducts the lubricating oil subjected to the centrifugal force of the eccentric shaft into an oil space 23 in the central plate 3. The lubricating oil circuit is closed when the lubricating oil runs back from that space under the force of gravity into the oil tank.

The inventive advantage of the bevels 8, 9, and 10 lies in the clearly definable direction which they give to the oil circulation from the front of the working unit to the rear, in the reduction of the splash losses, and in the increase in the cooling action on the internal surfaces of the thermally stressed piston 4.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rotary combustion engine having at least one working unit, each working unit comprising:

a peripheral housing describing an epitrochoidal orbit;

a front housing plate;

a rear housing plate;

an eccentric shaft mounted for rotation, said shaft having an interior space for receiving lubricating oil from an oil tank and an eccentric in said housing between said front and rear plates;

a front sealing part fixed to the eccentric between the eccentric and the front housing plate;

a rear sealing part fixed to the eccentric between the eccentric and the rear housing plate;

a first main bearing, a second main bearing, and an eccentric bearing on said shaft, said bearings receiving lubricating oil from said interior space;

a triangular piston mounted for rotation on said eccentric bearing, said piston having three tips which contact said epitrochoidal orbit to form three working spaces which pass through, in succession, a four-phase cycle; and wherein each of said front sealing part, said rear sealing part, and said piston has a conical surface for conveying lubricating oil from said bearings axially through said working unit in response to rotation of the eccentric and the piston, said front sealing part having a conical inside surface with a diameter which increases toward the rear housing plate.

2. The rotary combustion engine of claim 1 wherein the lubricating oil is conveyed in a flow direction from the front housing plate, through the piston, through the eccentric, and toward the rear housing plate.

3. The rotary combustion engine of claim 1 wherein the rear sealing part has a conical inside surface with a diameter which increases toward the rear housing plate.

4. The rotary combustion engine of claim 1 wherein the piston comprises a hub ring having a conical outside surface with a diameter which decreases toward the rear housing plate.

5. The rotary combustion engine of claim 1 comprising a first conveying space which receives lubricating oil from said first main bearing and a piston space in said piston, said front sealing part having a channel located adjacent to a radially outward part of the eccentric, said channel conveying lubricating oil from said first conveying space to said piston space.

6. The rotary combustion engine of claim 5 further comprising a second conveying space and an oil space in the rear housing plate, the rear sealing part having a guide ring with a shape which prevents oil from being conveyed by centrifugal force from said second conveying space and said oil space into said piston space.

7. The rotary combustion engine of claim 6 wherein the rear sealing part has a recess adjacent to the radially outward part of the eccentric, said recess connecting said second conveying space to the piston space and to the oil space.

8. A rotary combustion engine having at least one working unit, each working unit comprising:

a peripheral housing describing an epitrochoidal orbit;

a front housing plate;

a rear housing plate;

an eccentric shaft mounted for rotation, said shaft having an interior space for receiving lubricating oil from an oil tank and an eccentric in said housing between said front and rear plates;

a front sealing part fixed to the eccentric between the eccentric and the front housing plate;

a rear sealing part fixed to the eccentric between the eccentric and the rear housing plate;

a first main bearing, a second main bearing, and an eccentric bearing on said shaft, said bearings receiving lubricating oil from said interior space;

a triangular piston mounted for rotation on said eccentric bearing, said piston having three tips which contact said epitrochoidal orbit to form three working spaces which pass through, in succession, a four-phase cycle;

means for conveying lubricating oil from said bearings axially through said working unit in response to rotation of the eccentric and the piston;

a first conveying space which receives lubricating oil from said first main bearing and a piston space in said piston, said front sealing part having a channel located adjacent to a radially outward part of the eccentric, said channel conveying lubricating oil from said first conveying space to said piston space; and a second conveying space and an oil space in the rear housing plate, the rear sealing part having a guide ring with a shape which prevents oil from being conveyed by centrifugal force from said second conveying space and said oil space into said piston space.

9. The rotary combustion engine of claim 8 wherein the lubricating oil is conveyed in a flow direction from the front housing plate, through the piston, through the eccentric, and toward the rear housing plate.

10. The rotary combustion engine of claim 8 wherein the means for conveying lubricating oil comprise formations on the sealing parts and the piston which accelerate the oil in the flow direction.

11. The rotary combustion engine of claim 10 wherein the formations are conical surfaces.

12. The rotary combustion engine of claim 11 wherein the front sealing part has a conical inside surface with a diameter which increases toward the rear housing plate.

13. The rotary combustion engine of claim 11 wherein the rear sealing part has a conical inside surface with a diameter which increases toward the rear plate.

14. The rotary combustion engine of claim 11 wherein the piston comprises a hub ring having a conical outside surface with a diameter which decreases toward the rear housing plate.

15. The rotary combustion engine of claim 8 wherein the rear sealing part has a recess adjacent to the radially outward part of the eccentric, said recess connecting said second conveying space to the piston space and to the oil space.

* * * * *